United States Patent [19]

Tarro

[11] 4,008,823

[45] Feb. 22, 1977

[54] CONTAINER WITH ATTACHED PULL TAB OPENER

[76] Inventor: Richard E. Tarro, 425 Broadway, Providence, R.I. 02914

[22] Filed: Aug. 11, 1975

[21] Appl. No.: 603,590

[52] U.S. Cl. ..... 220/269; 220/334; 220/270

[51] Int. Cl.² ..... B65D 41/32

[58] Field of Search ..... 220/268, 269, 270, 334

[56] References Cited

UNITED STATES PATENTS

| | | | |
|---|---|---|---|
| 3,731,836 | 5/1973 | Silver | 220/269 |
| 3,813,000 | 5/1974 | Underwood | 220/269 |
| 3,847,300 | 11/1974 | Waters | 220/269 |
| 3,908,856 | 9/1975 | Perry | 220/269 |

*Primary Examiner*—George T. Hall
*Attorney, Agent, or Firm*—Max Schwartz

[57] ABSTRACT

A container having a pull tab secured to a scored removable section. A pivot member, metal or plastic, is pivotally riveted at one end to the container top. The other end of the member overlies the removable section inner and is attached to it by riveting, welding or gluing. When the pull tab is used to tear the removable section from the top, it remains attached to the pivot member and can be swung to one side to permit pouring or drinking from the opening. In a resealable container having a central air opening and a peripheral pouring opening, a plastic closure extends over and is bonded to the scored portions of both openings. The plastic closure is pivotally riveted to the top between the openings and is provided with a pull tab at each end. When the tabs are pulled toward each other both openings will be opened and the closure can be pivoted at right angles to expose them for pouring. The closure can then be swung back over the openings and pressed in to close them again. A seal may be provided to indicate that the container has been opened and resealed. This resealable construction can also be used with a single opening.

10 Claims, 14 Drawing Figures

CONTAINER WITH ATTACHED PULL TAB OPENER

BACKGROUND OF THE INVENTION

This application constitutes a continuation in part of my copending application Ser. No. 422,265, filed 12/6/73, and entitled Container With Attached Pull Tab Opener.

Most easy opening containers or cans provide the metal top with a scored removable portion. A pull tab is attached to this portion. When the tab is pulled, the scored portion is torn out and discarded leaving a pouring opening. This presents a sharp-edged piece to dispose of. In another version, the removable portion is replaceable. This reseals the opening. It usually comprises an elongated plastic piece bonded to the scored portion of the pouring opening and a central air vent. A pull tab is used to remove the piece and it can be snapped back for resealing. U.S. Letters Patent No. 3,441,167, issued Apr. 29, 1969, shows such a construction. This device presents problems caused by the loss of the closure after its removal, or tampering with the container on the shelf by opening and then resealing. There is no indication that this has been done to the container.

SUMMARY OF THE INVENTION

The present invention provides an important improvement over the art in that the scored section remains attached to the container after being pulled from the pouring opening with the tab. A pivot member is pivotally attached at one end to the container top adjacent the center. The other end, in an L-shape, overlies the scored section and is attached to it. The pull tab is provided with a sharply bent portion snapping over the edge of the container to lock the assembly in place. When the tab is pulled to tear the scored section from the top, it remains attached to the pivot member and the assembly can be swung to one side until the bent portion of the pull tab engages the rim to lock it in place away from the opening.

In a resealable container having a central air vent and a peripheral pouring opening, a plastic member is attached to both scored sections and is pivotally attached to the container top between the openings. A pull tab is mounted at each end so that both openings can be opened simultaneously. A twist will pivot the device out of the way and another twist will pivot it back for resealing. Similarly, the single opening construction can also be made resealable.

DESCRIPTION OF THE INVENTION

Figure 1:
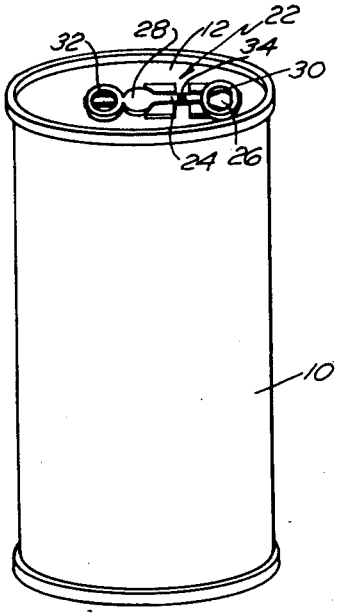
FIG. 1 is a perspective view of a resealable container having an opener of the present invention.

The present invention basically provides as easy opening container in which the portion of the metal that is removed to form the opening remains attached to the container and is not discarded independently thereof. FIGS. 1 to 4, inclusive, show the device applied to a resealable container. Referring to the drawings, a conventional metal container or can 10 is provided with an annular metal top 12. The top 12 is provided with a scored section 14 which, when removed, leaves the pouring opening 16. In addition, the larger cans are also provided with a central opening 18 for an air vent. This opening 18 is also closed by a scored member 20.

The opening device comprises a plastic elongated strip 22 having an elongated narrow body portion 24 and an integral broader end 26 which is bonded to the scored section 14. Adjacent the other end, the member 22 is provided with an enlarged area 28 which is bonded to the air vent closure 20. Each end of the member 22 is provided with a pull tab extending inwardly, the pull tab 30 at the outer end and the pull tab 32 at the inner end.

The feature of the device comprises a pivot rivet 34 extending through the member 22 and the top 12 to pivotally mount the member 22 on the top. Now, when the tabs 30 and 32 are manually grasped and pulled up and toward each other, the scored sections 14 and 20 will be removed with the member 22. The entire assembly can then be pivoted into the position shown in FIG. 3, clearing the openings 16 and 18. The assembly can then be twisted back into the position shown in FIG. 2 and the portions 14 and 20 pressed back into place to reseal the can.

Figure 2:
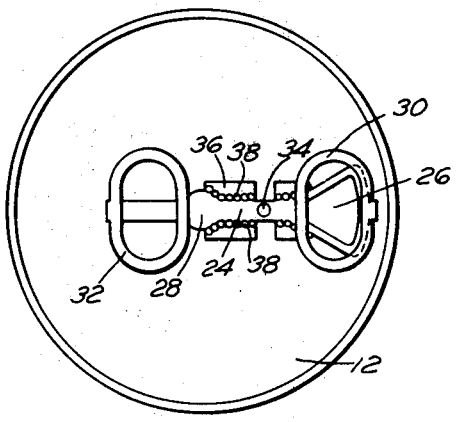
FIG. 2 is a top plan view thereof.
Figure 3:
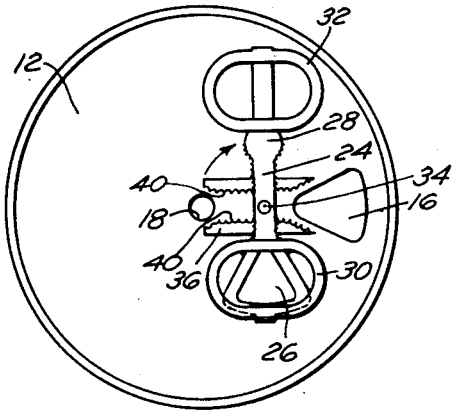
FIG. 3 is a view similar to FIG. 2 showing the device in open position.

The above construction thus eliminates any problems which may result from the loss of the member 22 which remains attached to the can after opening. To prevent tampering, a seal may be provided to show when the can has been opened. One form of seal is illustrated in FIG. 2 and 3. A strip of plastic 36 is welded to the member 22 so that it extends out from each side and is bonded to the can cover 12. The plastic 36 is provided with perforations 38 along each side of the member 22. When the tabs are pulled upwardly to open the can, the plastic will tear along the perforations leaving the torn edges 40 as a tell-tale indicator that the tab has been opened. Other forms of seals may also be used.

Figure 5:
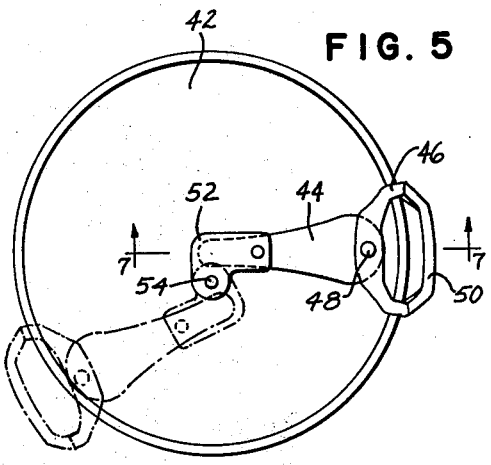
FIG. 5 is a top plan view of a single opening container with a device of the present invention.
Figure 4:
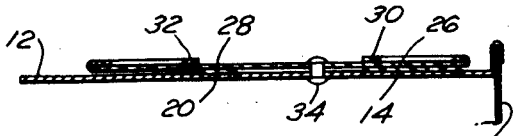
FIG. 4 is a longitudinal section through FIG. 2.
Figure 6:
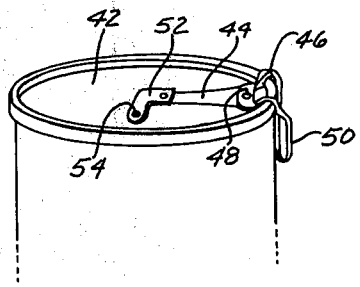
FIG. 6 is a perspective view of the device shown in FIG. 5.
Figure 7:
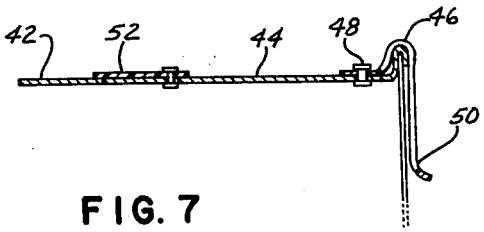
FIG. 7 is a longitudinal section of FIG. 5.

The attachment to the can cover of the removable portion of the opener is illustrated in a single opening can in FIGS. 5, 6 and 7. In this form the can top 42 is provided with the usual scored portion 44. In conventional cans, the scored portions extend from adjacent the rim of the top 42 to the center, see FIG. 5. The pull tab 46 is conventionally mounted at the outer end of the portion 44 by a rivet 48. The pull tab 46 is provided with an integral sharply bent edge portion 50 which normally snaps over the rim edge of the top 42 to lock it in place.

In accordance with the present invention, I provide an L-shaped pivot member 52 which may be metal or plastic. The longer arm of the member 52 overlies the inner end of the scored portion 44, FIG. 5, and is attached to it by bonding, gluing, snap fastening or riveting (see FIG. 7). The short arm portion is pivotally attached to the can top 42 by the rivet 54. This pivot point 54 is thus out of alignment with the axis of the scored portion 44.

Now, when the tab 46 is pulled upwardly to tear the portion 44 from the can top 42, it will remain pivotally attached to the top. When it is swung to one side, dotted lines in FIG. 5, the tab 46 will swing clear at first because of the off center pivot 54. However, further clockwise movement will bring the tab 46 in engagement with the rim and lock it in place out of the way. The bent portion 50 permits the locking action, see FIG. 7. If desired, the scored portion 44 may be made resealable as in the form shown in FIGS. 8, 9 and 10.

Figure 8:
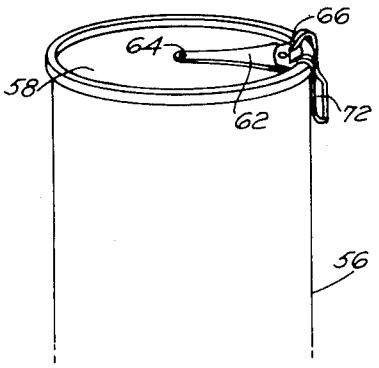
FIG. 8 is a perspective view of a modified form of the device shown in FIG. 5.
Figure 9:
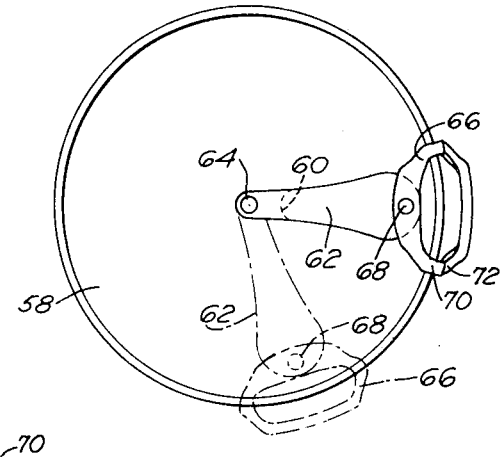
FIG. 9 is a top plan view of the container shown in FIG. 8.
Figure 10:
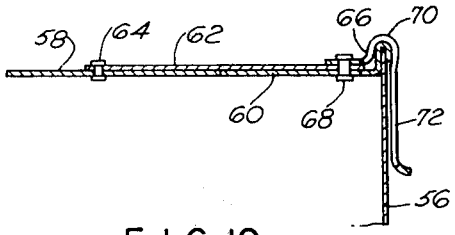
FIG. 10 is a longitudinal section of the device shown in FIG. 8.
Figure 12:
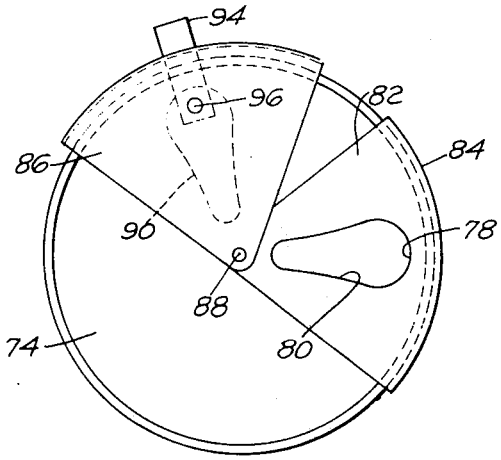
FIG. 12 is a view similar to FIG. 11 with the device in open position.
Figure 11:
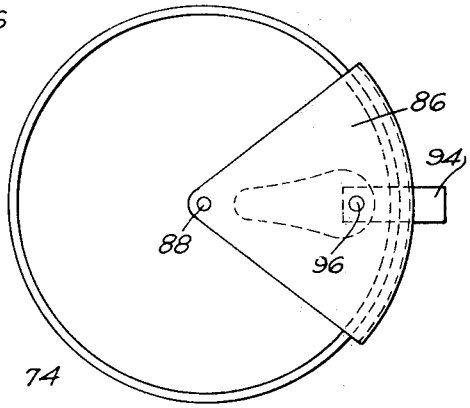
FIG. 11 is a top plan view of another form of container.

FIGS. 8, 9 and 10 thus illustrate the construction in a single opening resealable can. The can 56 is provided with the metal top 58 having the scored portion 60 for opening the can. An elongated pivot member 62 has its inner end riveted at 64 to the center of the top and extends across the top to completely cover the scored portion 60. The member 62 is bonded to the portion 60 and the pull tab 66 is attached by passing the rivet 68 through both the member 62 and the portion 60. When the tab is pulled to tear the portion 60 from the top, it remains attached to the member 62. It can thus be swung out of the way, as shown in dotted lines in FIG. 9, or bent back, to permit pouring or drinking. It can then be swung back and snapped into the opening to reseal the can. The seal arrangement shown in FIGS. 2 and 3 may be used to discourage tampering with the can. The tab 66 may also be constructed as illustrated so that it is sharply bent at 70 to snap over the edge of the can. This will hold it in place in resealing or open position. The tab is elongated at 72 to permit the six pack carton to grasp the can without interference.

The arrangement shown in FIGS. 11 to 14 is a modified version of the single opening resealable can providing a sanitary drinking area. The can top 74 is provided with a scored portion 76 for forming the opening 78. A generally triangular base plastic member 82 is bonded to the top of the can 74 and has a cut out portion 80 aligned with the portion 76 to expose the scored portion. At the edge, the member 82 thins down to form a plastic coating over the edge of the can at 84. When the can is used for drinking, the mouth will touch the plastic coat 84 rather than the metal of the can.

Figure 13:
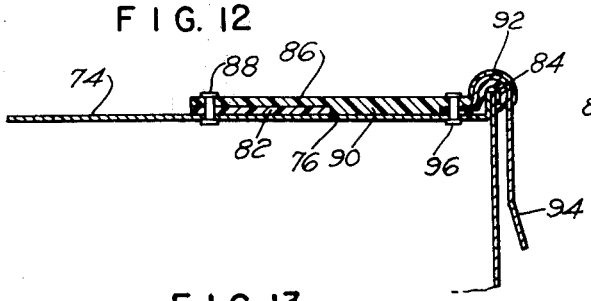
FIG. 13 is a longitudinal section of the device shown in FIG. 11.
Figure 14:
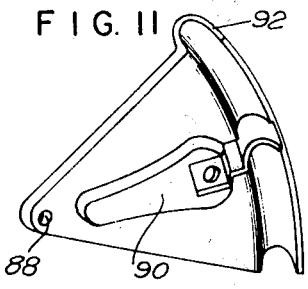
FIG. 14 is a perspective view of the closure member for the form shown in FIG. 11.

The closure member, FIG. 14, comprises a triangular member 86 attached at the apex 88 to the can top, FIG. 13. It is provided with a double thickness 90 shaped to fit into the opening 80 and to bond to the top of the scored portion 76. The member 86 has a thin inverted U-shaped edge 92 for snapping over the plastic edge 84 in closed position. The pull tab 94 is attached under the portion 86 to a rivet 96 which passes through the tab, scored portion, and member 86. If desired, the tab 94 can be imbedded in the member 86 for a more sanitary arrangement. The tab is also elongated to avoid interference with the six pack carton. When the tab is lifted, it will lift the member 86 and tear the portion 76 from the top. The assembly can be swung to one side, dotted lines in FIG. 12, and can be swung back and snapped into reseal the can. This form may also be provided with a telltale seal such as shown in FIG. 2 to prevent tampering.

In all of the forms, the portion of the container or can which is torn out to form the pouring or drinking opening remains attached to the can top. The same is true of the resealable can with one or two openings. Provision is also made for a seal to indicate that the can has been opened to prevent tampering.

In the manufacture of cans, the top portion with its pull tabs is usually formed separately and then joined with the can body. This allows for the top or bottom of the can to be of a different material than the body. For example, for recycling, the cans are often separated from garbage or rubbish by the use of electro-magnets. However, aluminum or other non-ferrous cans will not respond to the magnet. It can be made so by making the top or bottom of such can out of steel, or even just the pull tab out of steel. Finally, even a steel wire rim would be sufficient to make the can responsive to the magnet.

Other advantages of the present invention will be readily apparent to a person skilled in the art.

I claim:

1. A pull tab opener device for a container having a metal top comprising a scored portion outlining the opening, said scored portion being of a generally oval shape aligning axially with a radius of the top, said scored portion having an enlarged end adjacent the outer perimeter of the top and a small end at the inner end, a pull tab attached to said scored portion adjacent the outer edge thereof on the enlarged end, said pull tab having a portion bent over the edge of the container to extend below the edge, said bent portion snapping over the edge of the container to releasably retain said tab in open or closed position, and means for pivotally attaching the inner small end of said scored portion to the metal top of the container.

2. A pull tab opener as in claim 1, wherein said attaching means comprises a member having one end pivotally mounted on the container top, the other end of said member overlying the inner small end of said scored portion, and means for attaching said member to said scored portion small end.

3. A pull tab opener as in claim 1, wherein said attaching means comprises an L-shaped member having a short leg pivotally mounted on the container top offset from the center of said container top, the longer leg of said member overlying the inner small end of said scored portion, and means for attaching said longer leg to said scored portion small end.

4. A pull tab opener as in claim 1, wherein said attaching means comprises a plastic strip having its inner end attached to the container top, the other end of said strip being bonded to said scored portion, said tab being mounted on said scored portion through said strip, whereby said scored portion and attached strip may be snapped back into the opening to reseal the can.

5. A pull tab opener as in claim 1, wherein said attaching means comprises a triangular plastic base bonded to said top, said base having an opening over said scored portion, said base extending over the edge of said can to form a sanitary drinking edge, a triangular plastic closure member, the apex of said member being riveted to the can top, said member having a thick portion entering said base opening and bonded to said scored portion, said pull tab being attached to said scored portion and said pivot member.

6. A pull tab opener as in claim 4, wherein said strip is provided with a sealing device, said device being broken when said can is opened.

7. A pull tab opener device for a container having a metal top comprising a scored portion outlining the opening, a pull tab attached to said scored portion, an inner second scored portion in said top outlining an air vent opening, a second tab for opening said second scored portion, an elongated plastic member mounted over said scored portions and bonded thereto, said pull tabs being mounted on said plastic member, one adjacent each end, said member being adapted to be pushed into said openings to reseal the openings after removal of said scored portions.

8. A pull tab opener as in claim 7, wherein said plastic member is pivoted to said can top by a rivet positioned between said scored portions.

9. A pull tab opener as in claim 7, wherein said plastic member is provided with a sealing device, said device being broken when said can is opened.

10. A pull tab opener as in claim 9, wherein said sealing device comprises a strip of plastic material extending from each side edge of said member and bonded to said top, said strip having perforations at each side edge, whereby said strip will be torn when said strip is lifted to open the container.

* * * * *

UNITED STATES PATENT OFFICE

CERTIFICATE OF CORRECTION

Patent No. 4,008,823 Dated Feb. 22, 1977

Inventor(s) RICHARD E. TARRO

It is certified that error appears in the above-identified patent and that said Letters Patent are hereby corrected as shown below:

Cancel Claims 6 to 10, inclusive.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*